US005417001A

United States Patent [19]

Rousseau

[11] Patent Number: 5,417,001

[45] Date of Patent: May 23, 1995

[54] FIRING MECHANISM FOR FIRE ARMS

[75] Inventor: Joseph F. N. Rousseau, Mountain Green, Utah

[73] Assignee: Browning SA, Herstal, Belgium

[21] Appl. No.: 274,166

[22] Filed: Jul. 14, 1994

[30] Foreign Application Priority Data

Jul. 14, 1993 [BE] Belgium ..... 09300727

[51] Int. Cl.[6] ..... F41A 17/30; F41A 17/56; F41A 17/74

[52] U.S. Cl. ..... 42/70.08; 42/69.03; 42/70.01

[58] Field of Search ..... 42/70.08, 70.06, 70.05, 42/70.04, 70.01, 69.03

[56] References Cited

U.S. PATENT DOCUMENTS

| | | | |
|---|---|---|---|
| 1,376,165 | 4/1921 | Rosebush | 42/70.01 |
| 3,903,631 | 9/1975 | Vesamaa | 42/70.08 |
| 4,151,670 | 5/1979 | Rath | 42/70.06 |
| 4,272,957 | 12/1983 | Chestnut et al. | 42/75.02 |
| 5,067,266 | 11/1991 | Findlay | 42/70.08 |
| 5,068,990 | 12/1991 | Marzocco | 42/70.04 |
| 5,149,898 | 9/1992 | Chestnut | 42/70.04 |
| 5,225,611 | 7/1993 | Scott | 42/70.08 |
| 5,274,939 | 1/1994 | Scaramucci et al. | 42/69.03 |

FOREIGN PATENT DOCUMENTS

| | | |
|---|---|---|
| 0428292 | 5/1991 | European Pat. Off. . |
| 1044264 | 11/1953 | France . |
| 345118 | 12/1921 | Germany . |
| 664737 | 1/1952 | United Kingdom . |

*Primary Examiner*—David Brown
*Attorney, Agent, or Firm*—Bacon & Thomas

[57] ABSTRACT

Firing mechanism for fire arms, includes a hammer (5) revolving between a "cocked" position and a "tumbled" position which makes contact with the striker (4), a tumbler (8) which can retain the hammer (5) in the cocked position, a trigger (13) which controls the tumbler (8), an assembly (20) to make the hammer (5) revolve from its cocked position towards the striker (4) of the arm when the hammer (5) is released by the tumbler (8), and a security device containing a bolt element (27) which can be manually locked and which can lock the trigger (13). The bolt element (27), in the security position, not only cooperates with the trigger (13), but simultaneously with the assembly (20) to make the hammer revolve in order to prevent the hammer (5) from knocking against the striker (4) as long as the bolt element (27) is in its security position.

9 Claims, 4 Drawing Sheets

FIRING MECHANISM FOR FIRE ARMS

BACKGROUND OF THE INVENTION

The invention concerns a firing mechanism for fire arms, whereby such mechanism contains a hammer revolving between a "cocked" position and a "tumbled" position which makes contact with the striker, a tumbler which can retain the hammer in the cocked position, an actual trigger which controls the tumbler, means to make the hammer revolve from its cocked position towards the striker of the arm when the hammer is released by the tumbler, and a security device containing a breech bolt element which can be manually locked and which can lock the trigger and the hammer.

It is generally known to provide fire arms with a bolt, which can be manually locked, for the trigger or with an element connected thereto in order to prevent the involuntary release of the hammer when the arm is cocked. It is not excluded, however, in particular when the arm is handled in a ruthless manner, for example when it drops, that the hammer can hit the striker although the security device is locked, i.e. in its security position. It is indeed possible that, as a result of a shock, the tumbler revolves involuntarily or breaks, or that the part of the hammer working in conjunction with the tumbler breaks.

SUMMARY OF THE INVENTION

The invention aims to remedy this disadvantage and to provide a firing mechanism with an extra security preventing without fail that the hammer makes contact with the striker as long as the security device is locked.

According to the invention, this aim is reached as the bolt element, in its security position, not only cooperates with the trigger, but simultaneously with the means to make the hammer revolve in order to prevent the hammer from knocking against the striker as long as the bolt element is in said position.

According to a particular embodiment of the invention, the bolt element can be moved in a direction parallel to the revolving axis of the hammer and contains a part cooperating in the security position with the trigger, and another part cooperating in the same position with the means to make the hammer revolve.

The means to make the hammer revolve may contain a rod of which one end is fixed in a revolving manner to the hammer, at a distance from its revolving axis, and a button pushing the other end of the rod, whereby this other end is provided with a hook which can work in conjunction with the corresponding part of the bolt element.

BRIEF DESCRIPTION OF THE DRAWINGS

In order to better explain the characteristics of the invention, a preferred embodiment is described hereafter by way of example only and without being limitative in any way, with reference to the accompanying drawings, where.

DETAILED DESCRIPTION OF THE PREFERRED EMBODIMENT

Figure 1:
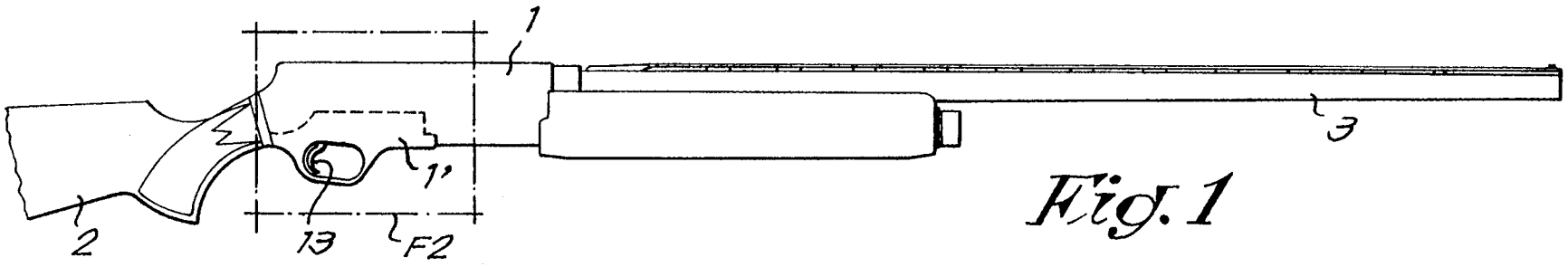
FIG. 1 represents a gun with an incorporated firing mechanism according to the invention.

The gun according to FIG. 1 contains, in a known manner, a casing 1 with the trigger guard 1', a grip 2 mounted on an end on the casing, a barrel 3, mounted on the other end of the casing 1 and, inside the casing 1, a striker 4 (see FIG. 5), a loading mechanism and a firing mechanism.

Figure 4:
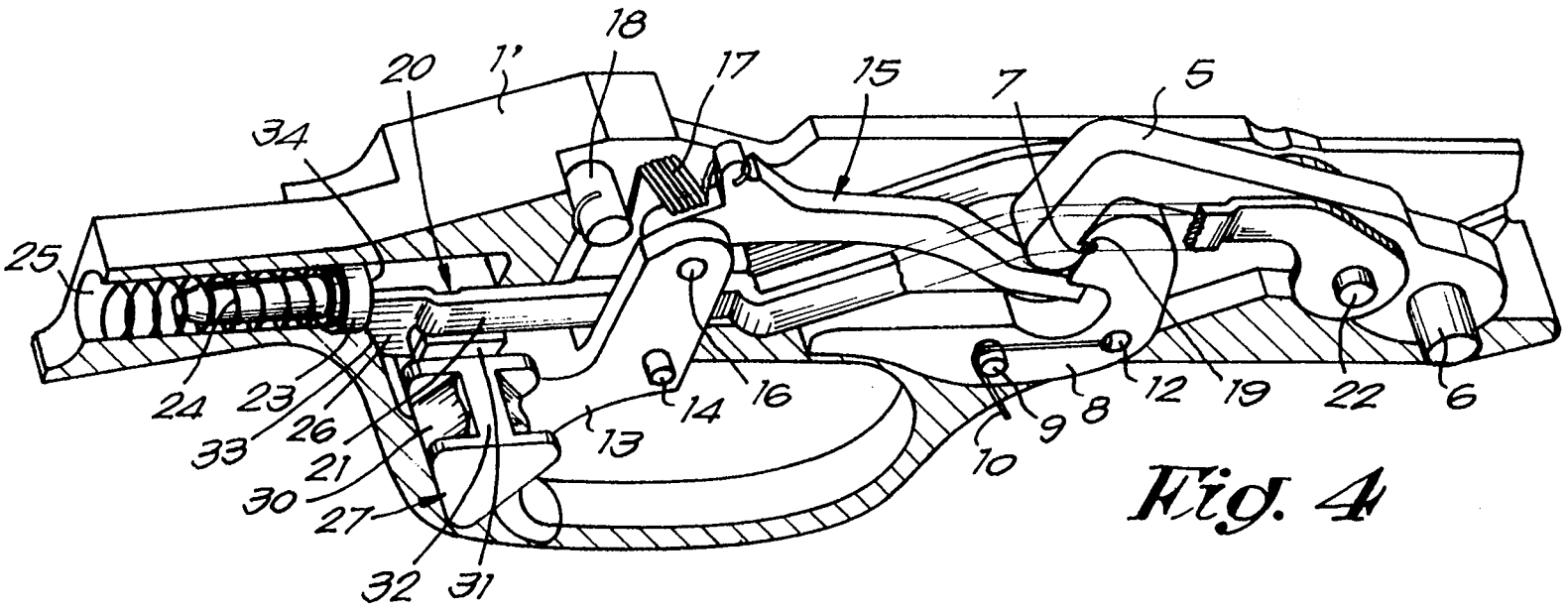
FIG. 4 represents a view in perspective of the part of the gun represented in FIG. 2.
Figure 2:
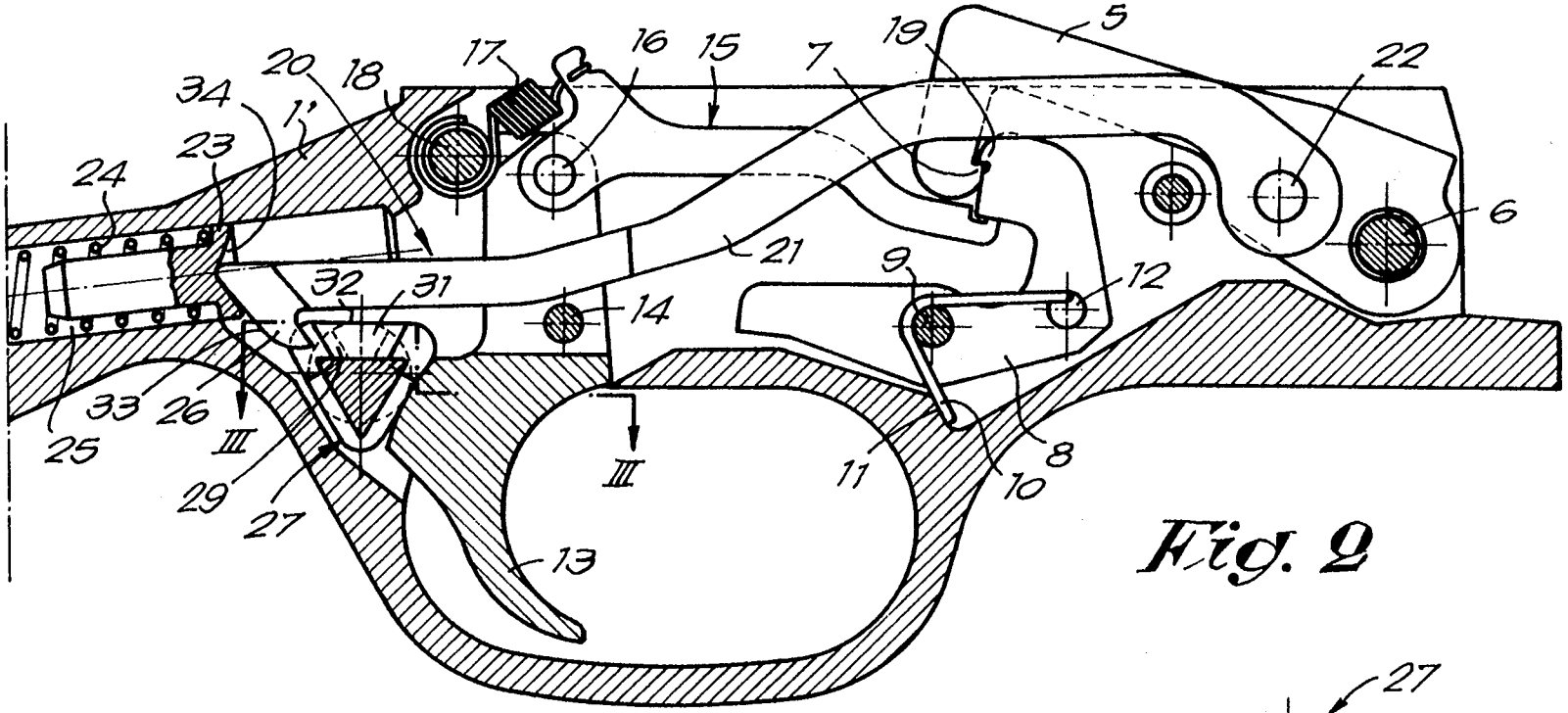
FIG. 2 shows a longitudinal section of the part indicated by F2 in FIG. 1, a part which is generally called the "trigger guard", to a larger scale and with the firing mechanism in the cocked position.
Figures 5, 6:
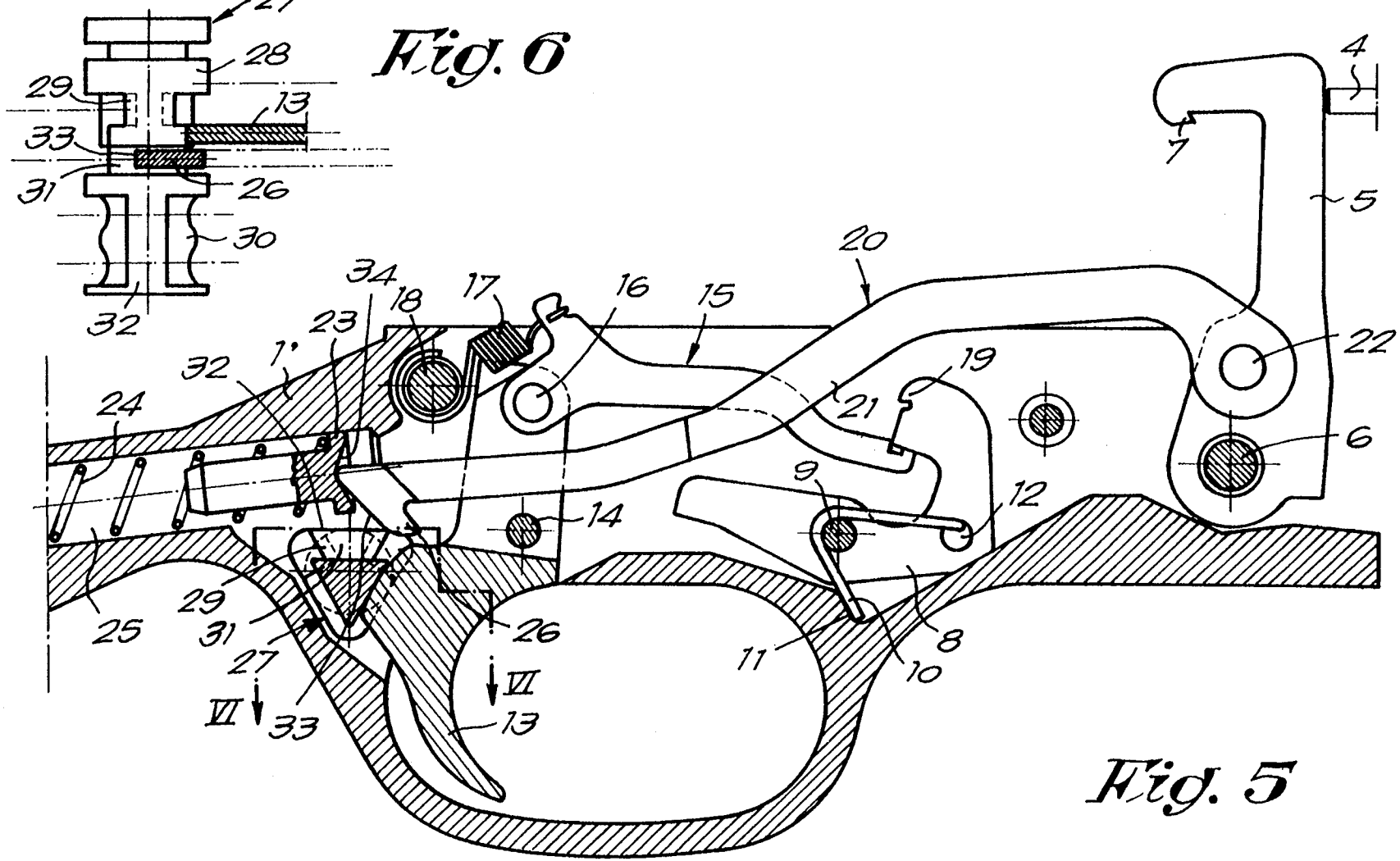
FIG. 5 represents a section similar to that in FIG. 2, but with the firing mechanism in the firing position and consequently the hammer in the tumbled position.
FIG. 6 represents a section according to line VI—VI of FIG. 5.

The firing mechanism contains, also in a known manner, a hammer 5 mounted in a revolving manner on the trigger guard 1' around a transversal axis 6 between a so-called "cocked" position as represented in FIGS. 2 and 4, and a so-called "tumbled" position as represented in FIG. 5, in which the hammer 5 knocks against the striker 4. This striker 4 is situated in front of the hammer 5, i.e. on the side of the barrel 3, in tumbled position. The part of the hammer 5 away from the axis 6 is folded back as seen in this position and forms a nozzle 7 at the end.

The firing device also contains an L-shaped tumbler 8, mounted in a revolving manner in the trigger guard 1' by means of an axis 9 and which can retain the hammer 5 in its cocked position. This tumbler 8 is retained in its cocked position, i.e. the position represented in FIG. 2 in which it retains the hammer 5, by means of a spring 10 under tension surrounding the axis 9 and resting against a part 11 of the trigger guard 1' on the one hand and inserted in a hole 12 provided in the tumbler 8 on the other hand.

An actual trigger 13 is mounted in a revolving manner in the trigger guard 1' by means of an axis 14 and controls the tumbler by means of a separator 15.

The separator 15 is mounted in a rotating manner between the two legs of the upper fork-shaped end of the trigger 13 by means of an axis 16. The axes 9, 14 and 16 are parallel to the axis 6 of the hammer 5. A spring 17 fixed on the one hand to a support 18 solid with the trigger guard 1' and on the other hand the separator 15, at a distance from the axis 16, pulls the separator and consequently the upper end of the trigger 13 backwards, i.e. in the normal position as represented in FIGS. 2 and 4.

The separator 15 is prevented from revolving due to the action of the spring 17 as its front end is taken under a backwards folded end of an arm of the tumbler 8.

This end is provided at the back with a notch 19 to which the nozzle 7 of the hammer 5 clings in the cocked position.

The firing mechanism also contains means 20 to make the hammer 5 revolve as soon as it is no longer retained by the tumbler 8, whereby these means 20 contain a hammer rod 21, extending between the fork arms of the trigger 13 and fixed at its front end to the hammer 5 in a revolving manner by means of an axis 22 parallel to but situated at a distance from the axis 6, and a button 23 pushed forward by a spring 24 acting on the rear end of the rod 21 and mounted in a pit 25 in the trigger guard 1'.

One of the characteristics of the invention is that the rear end of the rod 21 forms a hook 26.

The firing mechanism further contains a manual security device which is mainly composed of a bolt element 27, situated in a transversal opening in the trigger guard 1' and thus extending parallel to the axes 6, 9, 14 and 16.

Figure 7:
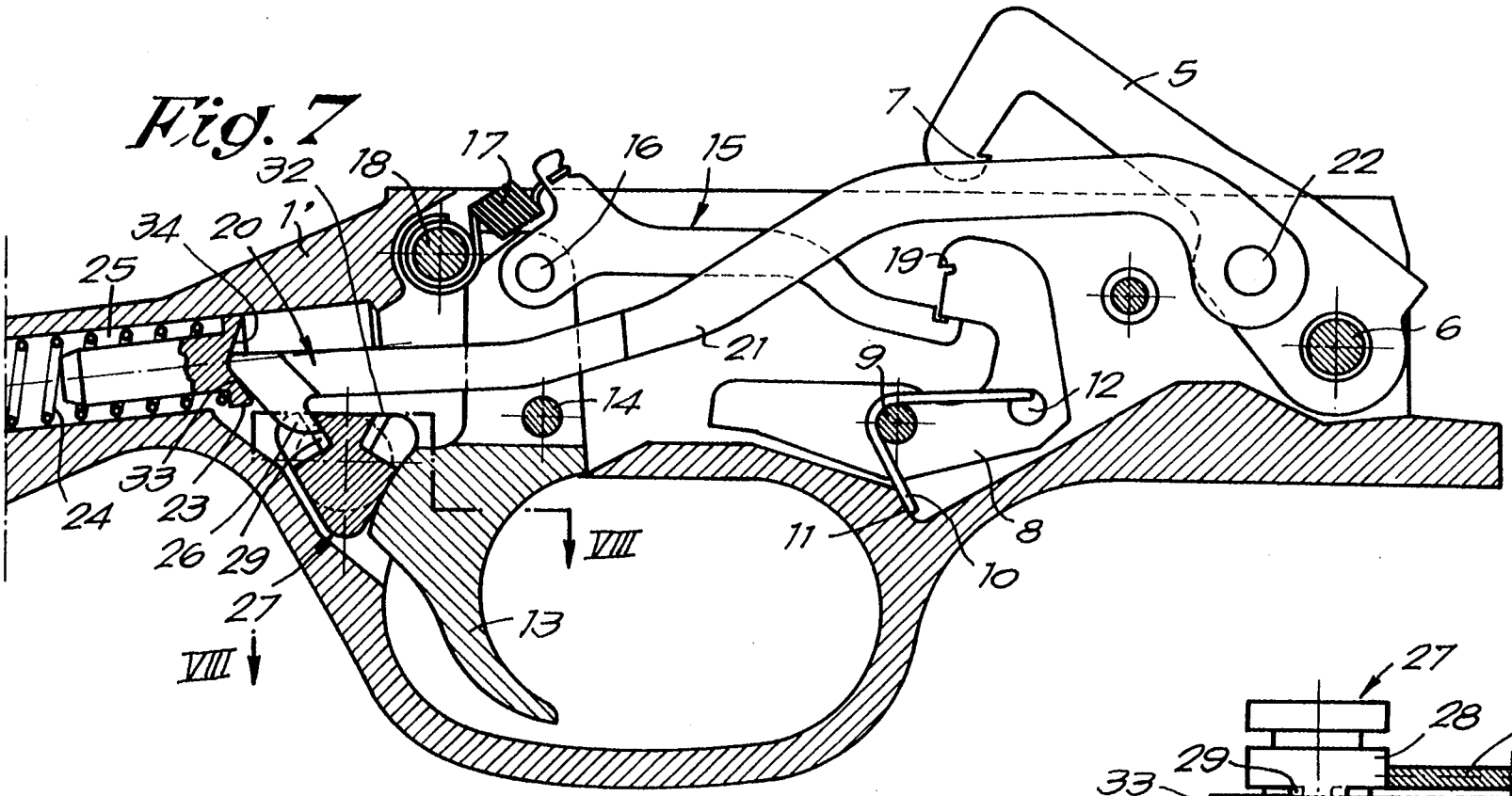
FIG. 7 represents a section similar to those in FIGS. 2 and 6, but in the case where the tumbler accidentally no longer retains the hammer in the cocked position whereas the security device remains in the security position.
Figure 8:
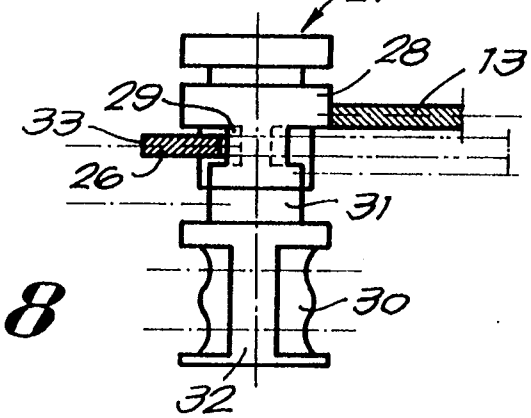
FIG. 8 represents a section according to line XIII—XIII of FIG. 7.

It is also characteristic in that this bolt element 27 does not merely contain a part 28 cooperating directly, in the security position, with the trigger 13 in order to prevent it from being set in motion, but also a part 29, cooperating in this position with the hook 26 of the rod 21 in order to retain it. The bolt element 27 can be moved from the security position, as represented in FIGS. 7 and 8, to the shooting position, as represented in FIGS. 2 to 6, by sliding it along its longitudinal axis, by means of a knob 30 formed at one end and protruding at the exterior of the trigger guard 1', on the right side or on the left side depending on the choice of the person using the arm, whereby the symmetry of the bolt element makes it reversible.

The part 28 has a section in the shape of a triangle with its point directed towards the bottom. The adjacent part 29 has the same section but with a notch in the two top corners so that they form a stop notch there in which the hook 26 of the rod 21 clings in the cocked position of the hammer 5 and the security position of the bolt element 27. This stop notch which is designed to receive the hook 26 is flanked on either side with a part of the bolt element 27 which protrudes in relation to the stop notch, such that, when the hook 26 is engaged in this stop notch, the change in position of the bolt element 27 is prevented by the presence of the hook 26. Between the elements 28 and 29 on the one hand and the knob 30 on the other hand, the bolt element 27 contains a part 31 with a triangular section but which is smaller than that of the part 28.

The firing mechanism works as follows:

The loading of the hammer 5 is done in the known manner. In the cocked position, the hammer 5 clings with its nozzle 7 in the notch 19 of the tumbler 8. The latter also retains the separator 15 in the position represented in FIG. 2. The rod 21 then pushes the button 23 against the spring 24.

When the bolt element 27 is in the security position, the part 28 makes contact with the trigger 13 and prevents any movement thereof. At the same time, the hook 26 of the rod 21 is situated behind and in front of the stop notch of the part 29. The hammer 5 can be loaded while the bolt element 27 is in the security position. To this end, when the rod 21 moves backwards, the oblique side 33 of the hook 26 makes the rear part of the rod 21, including the hook 26, go over the top side 32 of the bolt element 27. In doing so, the support of the rod 21 slides slantwise over the side 34 of the button 23. Once the hook 26 of the rod 21 has gone behind the stop notch of the part 29 of the bolt element 27, the action of the spring 24, in combination with the obliqueness of the side 34 of the button 23, draws the rear part of the rod 21, including the hook 26, in a position where the hook 26 faces the stop notch of the part 29 of the bolt element 27. Once it is loaded, the hammer 5 is thus secured until the bolt element 27 is put in shooting position.

Figure 3:
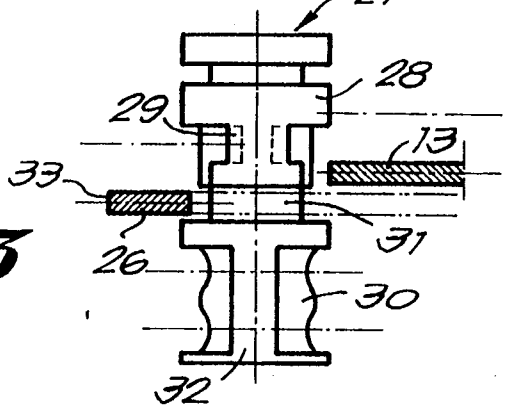
FIG. 3 represents a section according to line III—III in FIG. 2.

After the bolt element 27 has been released and thus has been put in shooting position, which is done by pushing the knob 30 and by moving the bolt element 27 into the position from FIG. 3, the firing mechanism is then in the position as represented in FIGS. 2 to 4. The hammer 5 keeps clinging to the tumbler 8 and nothing happens, but the trigger 13 can be drawn towards the back as it is situated opposite the smallest part 31 of the bolt element 27, and the rod 21 is no longer retained by the bolt element 27 since it is situated above said part 31 and thus next to the stop notch of the part 29.

When the trigger 13 is drawn towards the back, the separator 15 is pushed forward and makes the tumbler 8 tilt forward against the spring 10. The hammer 5 is thus released and, as the hook 26 of the rod 21 is not hindered in any way, it revolves into the tumbled position and knocks against the striker 4 as represented in FIGS. 5 and 6.

In FIGS. 7 and 8, the bolt element 27 is represented in the security position. As already explained, the trigger 13 is then locked and the hook 26 of the rod 21 faces the part 29 of the bolt element 27. If, for any reason whatsoever, for example an involuntary revolving of the tumbler 8 as a result of a shock or a mechanical failure such as the breaking of the hammer 5 or of the tumbler 8, the tumbler 8 no longer retains the hammer 5, the latter is prevented, however, by the rod 21 from knocking against the striker 4, this rod 21 forming an extra security and remaining clung to the bolt element 27.

Due to the fact that the hook 26 of the rod 21 is situated in one of the notches forming the stop notch of the part 29 of the bolt element 27, it is also impossible to put the bolt element 27 into shooting position. The hammer 5 must be reloaded first. If, after said reloading, the bolt element 27 can be put into shooting position, this implies that the untimely release of the hammer 5 was due to a shock and not to a mechanical failure, and the arm can be normally used.

If, however, after the hammer 5 has been reloaded, the bolt element 27 still cannot be put into shooting position, there is a mechanical failure which requires, in order to be repaired, the trigger guard block of the arm to be removed. The arm is then inoperative as long as this repair is not carried out.

The above-described firing mechanism provides more security and prevents the hammer 5 from knocking against the striker 4, even in case of a shock or a mechanical failure, when the bolt element 27 is in the security position.

The hammer 5 can be put from "tumbled" position into "cocked" position irrespective of the position of the security device, i.e. the bolt element 27 ("firing" position or "security" position).

The security device can be put into "shooting" position or "security" position irrespective of the position of the hammer 5 ("tumbled" or "cocked") except when, due to a mechanical failure, the hook 26 maintains contact with the part 29 of the bolt element 27.

It is clear that the above-described example can be modified in many ways while still remaining within the scope of the invention.

In particular, the shape of the bolt element is given as an example only. Other shapes are possible in so far that, in the security position, a part can prevent the movement of the trigger, while another part can simultaneously retain the rod of the hammer or any other means to make the hammer revolve when it is released from the tumbler.

The connection between the trigger and the tumbler must not necessarily consist of a separator. Indeed, the tumbler can be an element or a part of the trigger.

I claim:

1. A firing mechanism for a fire arm comprising:

a striker member;

a hammer mounted to the fire arm for rotation about an axis between a cocked position wherein said firing mechanism is set to fire and a tumbled position wherein said hammer makes contact with said striker member;

a tumbler movable between a first position wherein said tumbler retains said hammer in the cocked position and a second position wherein said hammer is released;

a trigger assembly for shifting said tumbler between said first and second positions, said trigger assembly including a manually actuatable trigger;

means for rotating said hammer from the cocked position, about said axis, into contact with said striker member when said hammer is released by said tumbler; and security means shiftably mounted between a shooting position wherein said trigger assembly is permitted to shift said tumbler and a security position wherein said security means prevents shifting of said tumbler through said trigger and prevents said hammer from rotating to said tumbled position, through said rotating means, even in the event said hammer is inadvertently released by said tumbler.

2. The firing mechanism according to claim 1, wherein said trigger assembly further includes a separator member having one end rotatably mounted to said trigger and another end engaged with said tumbler wherein actuation of said trigger member causes said tumbler to move, against the biasing force of a spring, to its second position.

3. The firing mechanism according to claim 1, wherein said security means is shiftable to either of said shooting and security positions irrespective of the position of said hammer except, when said firing mechanism experiences a mechanical failure, said security means is locked in said security position.

4. The firing mechanism according to claim 1, wherein said hammer can be rotated from said tumbled position to said cocked position irrespective of the position of said security means.

5. The firing mechanism according to claim 1, wherein said security means comprises a manually shiftable bolt element.

6. The firing mechanism according to claim 5, wherein said bolt element is shiftable in a direction substantially parallel to said axis, said bolt element including a first part adapted to be engaged with said trigger assembly and a second part adapted to be engaged with said rotating means when said security means is in said security position.

7. The firing mechanism according to claim 6, wherein said rotating means includes a rod and a button member, said rod having one end rotatably secured to said hammer at a location spaced from said axis and a second end provided with a hook engageable with the second part of said bolt element, said button member engaging the second end of said rod and biasing said rod toward said hammer.

8. The firing mechanism according to claim 7, wherein the second part of said bolt element is formed with a stop notch adapted to be engaged by said hook when said security device is in said security position.

9. The firing mechanism according to claim 7, wherein the first part of said bolt element is triangular-shaped in cross-section.

* * * * *